United States Patent [19]

Kupperman et al.

[11] 4,094,091

[45] June 13, 1978

[54] INTEGRALLY FORMED PLASTIC SPINNER TOY UNIT WITH MEANS FOR ATTACHING SAME TO A SUPPORT

[75] Inventors: Sam Kupperman, Chicago; Dennis Kupperman, Glenview, both of Ill.

[73] Assignee: R B Toy Development Co., Skokie, Ill.

[21] Appl. No.: 769,704

[22] Filed: Feb. 17, 1977

[51] Int. Cl.[2] ..... A63H 33/40

[52] U.S. Cl. ..... 46/53

[58] Field of Search ..... 46/1 R, 47, 51, 53

[56] References Cited

U.S. PATENT DOCUMENTS

| | | | |
|---|---|---|---|
| 1,225,379 | 5/1917 | Warner | 46/53 |
| 3,221,440 | 12/1965 | Gutierrez | 46/53 |
| 3,359,670 | 12/1967 | Pyc et al. | 46/53 |

*Primary Examiner*—Louis G. Mancene
*Assistant Examiner*—Robert F. Cutting
*Attorney, Agent, or Firm*—Vogel, Dithmar, Stotland, Stratman & Levy

[57] ABSTRACT

An integrally formed plastic molded spinner toy unit with means for attaching same to a support, such as the handlebars of a bicycle or the like in which the entire unit is integrally molded of plastic material and comrises an oval ring frame member, with a spinner molded within said frame member. The spinner has upper and lower journal pins which extend exteriorly of the spinner from the opposite sides. The frame member has bearings for detachably receiving the journal pins and the frame member is provided with attachment means exteriorly of the frame member to permit the entire unit to be readily secured to the handlebars of a child's bicycle or tricycle. The entire structure is molded in a one-shot operation and is placed unwrapped in a box of cereal as a premium item. When initially used, the spinner is readily detachable from the frame and the journal pins thereof are inserted into the bearings and when thus assembled and placed on a bicycle, the spinner will rotate with the portion of the bicycle. A structure thus formed, meets the requirements of U.S. Government Consumer Products Safety Commission.

11 Claims, 6 Drawing Figures

INTEGRALLY FORMED PLASTIC SPINNER TOY UNIT WITH MEANS FOR ATTACHING SAME TO A SUPPORT

SUMMARY OF THE INVENTION

One of the objects of this invention is to provide a toy in the form of a flat spinner which is integrally molded with an oval frame.

Another object of this invention is to provide a toy molded of a plastic material so economically produced that it may be given away and packed in a package of cereal or like food at no cost to the consumer. The integral nature of the toy is such that while it is a small size, it meets the requirements of the Government Consumer Products Safety Commission's safety guide regulations.

A still further object of the present invention is to provide a one piece molded plastic unit, comprising a frame member, a spinner positioned within said frame member and spaced therefrom, a pair of journal pins extending outwardly of said spinner, means connecting said spinner to said frame member for ready removal therefrom, said frame member including means for supporting said journal pins, and attachment means connected to said frame for attaching same to a support, said attachment means extending exteriorly of said frame member and molded integrally therewith, whereby detachment of said spinner from said frame member followed by mounting of said journal pins in said supporting means rotatably mounting said spinner in said frame.

These and other objects of the present invention will be more readily understood by reference to the following specification and drawings, in which:

BRIEF DESCRIPTION OF THE DRAWINGS

FIG. 6 is a view showing the toy mounted on the handlebars of a bicycle or the like.

DESCRIPTION OF THE PREFERRED EMBODIMENT

Figure 1:
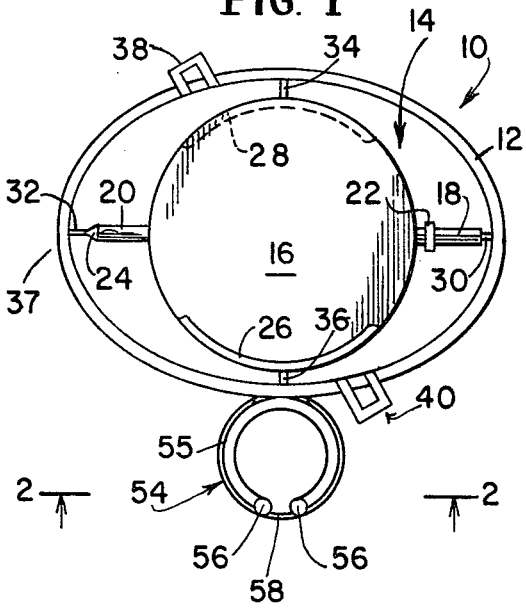
FIG. 1 is a plan view of the molded structure forming this invention.

The entire spinner toy unit is integrally molded in a plastic injection molding machine of plastic material and is produced as a one-shot injection with all of the components connected as best shown in FIG. 1. In this form the toy unit may be packed and placed with a cereal product or other food product without same being wrapped. In this unwrapped condition it meets the requirements of the Government Consumer Product Safety Commission's safety guidelines. After the consumer receives it, the toy unit is removed from the box containing the food products and the spinner is detached from its surrounding frame and positioned in the bearings of the frame to form the spinner toy unit shown in FIG. 6 so that it can be mounted on the handlebar of a bicycle or tricycle so that the spinner will rotate and spin continuously with movement of the handlebar. In appearance it tends to simulate that of a gyroscope.

The integrally formed spinner toy unit in its entirety is indicated generally by the numeral 10 and includes a continuous band frame member 12 which as shown is preferably oval shaped. The frame member 12 is rectangular in transverse section and while it may be slightly compressed by the fingers of the hand for the purpose of positioning the spinner 14 in its operating position, it will, when the slight manual pressure is released, return to its normal preformed oval shape and be sufficiently rigid to retain the spinner in its operating position. The plastic material may be rigid or semirigid, and may be formed of polypropylene, high or low density polyethylene or styrene.

Molded integrally with the oval shaped frame member 12 and within the boundary of the frame member is a spinner generally indicated at 14 which comprises a flat body portion 16 of circular shape. Extending outwardly of the flat body portion in diametrically opposed directions are two annular journal pins 18 and 20. The journal pins 18 and 20 will, when the device is assembled for operation as in FIG. 6, form the upper and lower journal pins respectively for the spinner 14. The journal pin 18 has a collar or ring 22 which is positioned closer to the body of the spinner than to the opposite end of the journal pin to maintain the position of the spinner 14 as will be explained. The journal pin 20 has a pointed end 24, as the spinner rests and is rotated on said end. The body portion 16 of the spinner has arcuate shaped vanes 26 and 28 which extend at right angles or perpendicular to the plane of the body portion 16 with the vanes extending in opposite directions, that is, one vane extends from one side of the body outwardly and the other vane extends from the other side of the body outwardly and each of the vanes is at the circular peripheral edge of the flat body. The vanes 26 and 28 are angularly opposite one another with respect to the axis of the spinner 14 formed by the two journal pins 18 and 20.

The spinner 14 when molded, is connected to the oval shaped frame member 12 at four spaced points namely at the two journal pins 18 and 20 by connections 30 and 32, respectively and also adjacent each of the vanes 26 and 28 by connections 34 and 36, respectively. The four connections 30, 32, 34 and 36, are formed integrally with the unit and have small diameters and are readily severable from the oval frame member 12 and spinner 14 to permit detachment of the spinner from the frame member.

The frame member 12 has a pointed projection 37 at one end and this forms and indicates the front end of the unit when in operating position. The frame member 12 is integrally formed with an upper extension which forms with the body of the frame member, the upper bearing generally indicated at 38 for the upper journal pin 18 and with a lower extension which forms with the body of the frame the lower bearing generally indicated at 40 for the lower journal pin 20. The upper bearing 38 has an extension 42 extending laterally from the body of the frame member 12 and is generally L-shaped in transverse section, but has a square-shaped opening 43 in same which communicates with a circular recess 44 in the body of the frame member. The vertical and horizontal openings in the L-shaped upper extension 42 permits insertion of the upper journal pin 18 of the spinner and provides the upper journal pin with the means which it is held therein for rotation and against accidental displacement, namely it serves as the upper bearing 38.

The lower bearing 40 has a lateral extension 46 which is also L-shaped in transverse section, but has an inwardly extending platform 48 and is provided with similar vertical and horizontal openings 50 which communicate with a circular recess 52 in the body of the frame 12. The lower extension 46 is diametrically opposite the upper extension 42. The lower extension 46 is inverted with respect to the upper extension 42, namely it extends downwardly as opposed to the upper one which extends upwardly.

Formed integrally with the oval shaped frame member 12 are means for attaching the toy unit to a support such as the handlbar of a bicycle or the like. Said means extend outwardly of the frame 12 and comprise an initially molded continuous ring-like member generally indicated at 54 (FIG. 1). The ring-like member has a thickened body portion or rib 55 for a portion of its circumference to provide strength for same and has spaced knob ends 56 formed therein. The plastic material 58 between the knob ends 56 which completes the ring is of a reduced thickness and is intended to be manually severed or detached from the formed ring so that when removed the formerly complete ring becomes a horseshoe shape as best shown in FIG. 5, to provide the gap between the ends to permit it to be positioned on the handlebar H of a bicycle or tricycle and held by said horseshoe-shaped member.

The unit of plastic material as seen in FIG. 1, is an integral unit and as an integral unit, satisfies the safety regulations of the U.S. Government Consumer Products Safety Commission and as such may be placed upwrapped in a box with a cereal or like product to be given away without additional cost to the consumer. The overall size of the unit as molded is approximately $3 \times 3\frac{1}{2}$ inches and this size, while sufficiently small to be easily packed in with the cereal box, is of a size so that it becomes impossible for a child to swallow the unit to sustain any injury therefrom.

Figure 6:
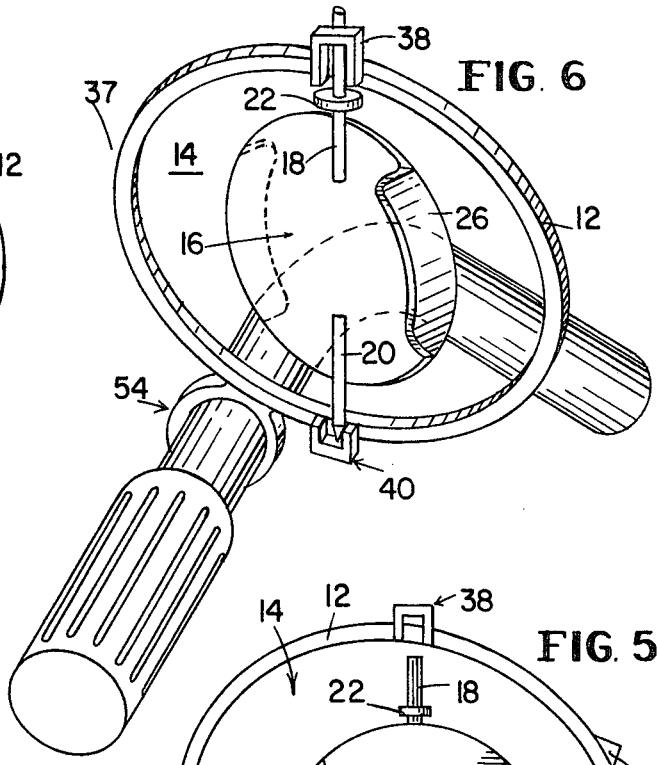
Figure 2:
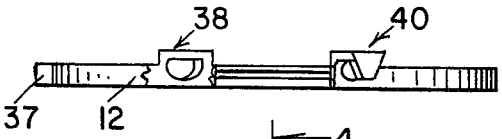
FIG. 2 is a side elevational view taken on lines 2—2 of FIG. 1.
Figure 5:
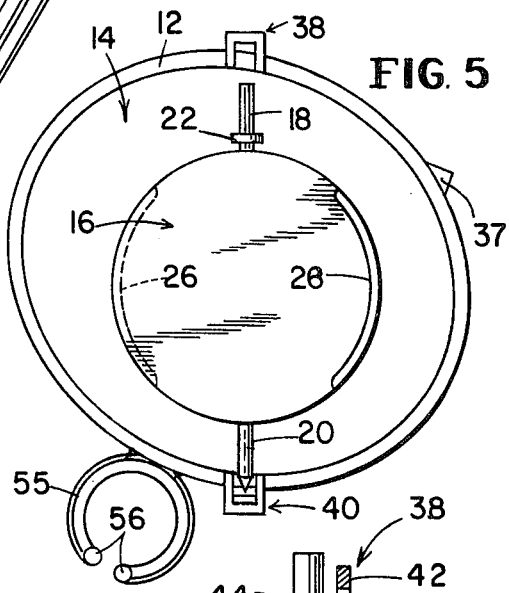
FIG. 5 is a view showing the oval shaped frame slightly compressed to permit insertion of the spinner.
Figure 3:
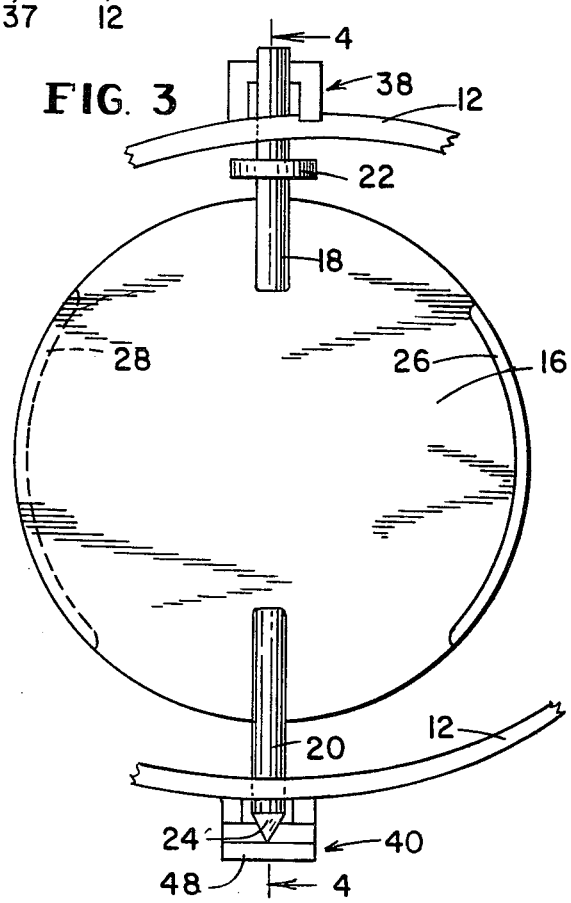
FIG. 3 is an enlarged elevational view showing the means of supporting the spinner in the bearings of the oval shaped form.
Figure 4:
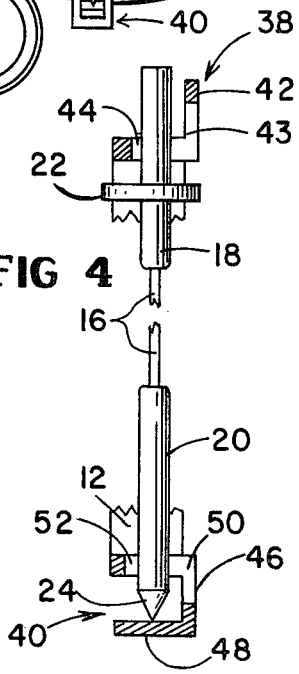
FIG. 4 is a fragmentary view partly in cross section taken on lines 4—4 of FIG. 3.

To put the toy together from the molded form of FIG. 1, to that of FIG. 6, the spinner 14 is detached from the integrally formed frame 12 by removing the material at 30, 32, 34 and 36; then the spinner is inserted in the frame member 12 by manually and slightly squeezing or compressing the frame from its oval shape towards a more rounded shape as shown in FIG. 5, where the upper bearing 38 is moved slightly away further from the lower bearing 40, to permit the journal pins 18 and 20 of the spinner 16 to be inserted in the respective openings of the upper and lower extensions 42 and 46. When manual pressure on the frame member is released, the frame member 12 will return to its oval shape as in FIG. 6, and the upper and lower journal pins 18 and 20 of the spinner will be held in their respective bearings 38 and 40, as shown in FIG. 4, with the lower pointed end 24 of lower journal pin 20, resting on the platform 48, with the lower bearing 24. The collar 22 prevents the spinner 14 and particularly the pin 18 from moving through the bearing 38, thereby ensuring proper placement of the spinner in the frame 12.

The unit is secured to the handlebar H in a position shown in FIG. 6, in which the axis of the journal pins 18 and 20 is substantially vertical with the projection 37 facing forward. As the bicycle moves forward or rearward, the spinner 14 will rotate, since the forward or rearward motion will cause the air to coact against the vanes 26 and 28 and keep the spinner rotating constantly as the bicycle moves.

The rotating spinner and the unit gives a gyroscopic visual effect and will provide a fascination for the child. It is seen therefore that there has been provided a one-piece molded unit easily fabricated into a novel toy in which a flat disc 16 rotatably mounted in an oval frame 12 is easily mounted on a bicycle or the like. The mounting mechanism 54 has a stiffened portion to ensure against unwanted movement of the toy about the handlebar.

The vanes should be centrally located between the journal pins for most efficient spinner rotation. If the vanes are angularly displaced from the central location to a great extent, the spinner will not rotate effectively, and therefore, to ensure proper visual effect, central location of the vanes is required.

While there has been described what at present is considered to be the preferred embodiment of the present invention, it will be appreciated that various modifications and alterations may be made therein without departing from the true spirit and scope of the present invention, and it is intended to cover in the appended claims all such modifications and alterations.

What is claimed is:

1. A one piece molded plastic unit, comprising a frame member, a spinner positioned within said frame member and spaced therefrom, a pair of journal pins extending outwardly of said spinner, means connecting said spinner to said frame member for ready removal therefrom, said frame member including means for supporting said journal pins, and attachment means connected to said frame for attaching same to a support, said attachment means extending exteriorly of said frame member and molded integrally therewith, whereby detachment of said spinner from said frame member followed by mounting of said journal pins in said supporting means rotatably mounting said spinner in said frame.

2. A structure as set forth in claim 1, in which the frame member is an oval shaped band.

3. A structure as set forth in claim 2, wherein said journal pins are diametrically opposite and form an axis which is substantially vertical when said unit is mounted on a support.

4. A structure as set forth in claim 1, wherein said journal pins support means are top and bottom bearings with the bottom bearing having a horizontal support surface receiving the bottom journal pin.

5. A structure as set forth in claim 4, in which the bearings are members extending laterally of said frame member and being generally L-shaped, said frame member having an opening in the body thereof adjacent and communicating with each of said L-shaped members to receive said journal pins.

6. A structure as set forth in claim 1, wherein said spinner is a flat disc.

7. A structure as set forth in claim 1, in which the spinner has vanes.

8. A structure as set forth in claim 7, wherein said vanes are diametrically opposite each other and extend along the circular edge of the spinner with the vanes extending in opposite directions therefrom.

9. A structure as set forth in claim 1, wherein said spinner is connected to said frame member by extensions from said journal pins, said extensions having a small diameter compared to said pins.

10. A structure as set forth in claim 1, in which the attaching means for attaching same to a support is a continuous ring having a portion thereof removable to form a horseshoe configuration.

11. A structure as set forth in claim 1, wherein the vanes are centrally located between the journal pins.

* * * * *